United States Patent [19]

Shade et al.

[11] Patent Number: 4,912,307

[45] Date of Patent: Mar. 27, 1990

[54] DEVICE FOR KEEPING SCORE DURING A SCORING GAME

[76] Inventors: Mary E. Shade, 4 Firwood Ct., Cockeysville, Md. 21030; Donna E. Verdis, 20 Lochmoor Ct., Lutherville, Md. 21093

[21] Appl. No.: 318,687

[22] Filed: Mar. 3, 1989

[51] Int. Cl.[4] ..... G06C 1/00

[52] U.S. Cl. ..... 235/123; 235/1 B; 116/324

[58] Field of Search ..... 235/1 B, 123; 116/321–324

[56] References Cited

U.S. PATENT DOCUMENTS

| | | | |
|---|---|---|---|
| D. 175,089 | 7/1955 | Newmark | D24/45 |
| 430,295 | 6/1890 | Mathewson | 63/3 |
| 753,457 | 3/1904 | Weissbrod | 248/444 |
| 1,142,294 | 9/1915 | Partant | 235/123 |
| 1,525,005 | 2/1925 | Sherman | 235/123 X |
| 1,979,585 | 11/1934 | Thompson | 235/123 |
| 2,992,495 | 7/1961 | Perreira | 235/123 X |

*Primary Examiner*—B. R. Fuller

*Attorney, Agent, or Firm*—Leonard Bloom

[57] ABSTRACT

A device for keeping score during a scoring game and, in particular, during a game of golf. A plurality of counting beads having respective passages formed therethrough are strung in a serpentine manner on respective first and second portions of a string, such that the first and second portions of string overlap one another in the passage of each bead. Score is kept by selectively sliding the beads along the length of string to a desired position, wherein they are maintained in place by the string.

21 Claims, 3 Drawing Sheets

DEVICE FOR KEEPING SCORE DURING A SCORING GAME

FIELD OF THE INVENTION

The present invention relates to devices for use in keeping score during a scoring game and, in particular, to a device for keeping score during a game of golf.

BACKGROUND OF THE INVENTION

Traditionally, when keeping score during a scoring game, resort is made to the use of paper and pencil. Unfortunately, such scoring devices can be troublesome where outdoor scoring games, such as golf, are involved. In such games, the use of pencil and paper to keep score is difficult and cumbersome and the paper and/or pencil can be easily lost which presents problems, especially since replacements therefor are often not readily available on the field of play.

In an attempt to solve the above problems, devices for keeping score while playing golf have been disclosed in U.S. Pat. Nos. 753,457 issued to Weissbrod and 1,979,585 issued to Thompson. Unfortunately, '457 still involves the use of a pencil which may be lost during play. The device of '585 can prove problematic in that it is secured directly to a golf club which can affect the players proper use thereof.

While beaded bracelets have long been utilized for ornamental purposes, they have not, to the best of my knowledge been utilized as scoring devices. Such bracelets of which I am aware have been described in U.S. Pat. Nos. 430,295 issued to Mathewson and D175,089 issued to Newmark. In both of these disclosures, the bracelets described therein are not capable of being utilized to keep score in that the particular ornamental elements thereof and maintained in one place and in that no means is provided thereby for such a purpose.

Thus, it can be seen that there remains a need for a device for keeping score during a scoring game and, in particular, for a player to keep his or her score during a game of golf.

SUMMARY OF THE INVENTION

It is a primary object of the present invention to provide a device for keeping score during a scoring game which does not utilize a pencil and/or paper.

It is another primary object to provide such a device that is capable of keeping a players score during a game of golf.

It is a further object of the present invention to provide such a device for keeping score that is simple, easy to use and which does not require the use of any elements that may be easily lost.

It is a still further object of the present invention to provide such a device for keeping score which does not need to be secured to the club of a player where it might interfere with the competitors playing ability.

In accordance with the teachings of the present invention, there is disclosed a device for keeping score during a scoring game. The device includes a plurality of counting beads. Each of said beads has a respective passage formed through at least a portion thereof. A length of string is provided having a pair of joined opposite ends. The string has a first portion that is strung in a serpentine manner through the passage of each bead in a first direction. The string also has a second portion that is string in a serpentine manner through the passage of each bead in a second direction.

In this fashion the length of string is threaded so that the first and second portions thereof overlap one another within the passage of each bead. This forms a length of string wherein the beads may be selectively slid along and retained in the position, permitting the score to be kept by the movement and placement of the beads.

These and other objects of the present invention will become readily apparent from a reading of the following description, taken in conjunction with the drawings enclosed herewith.

DESCRIPTION OF PREFERRED EMBODIMENTS

Figure 1:
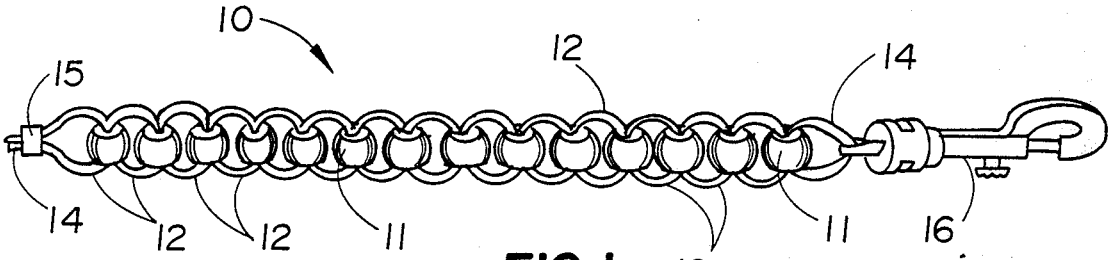
FIG. 1 is a perspective view of a first embodiment of the device of the present invention.
Figure 2:
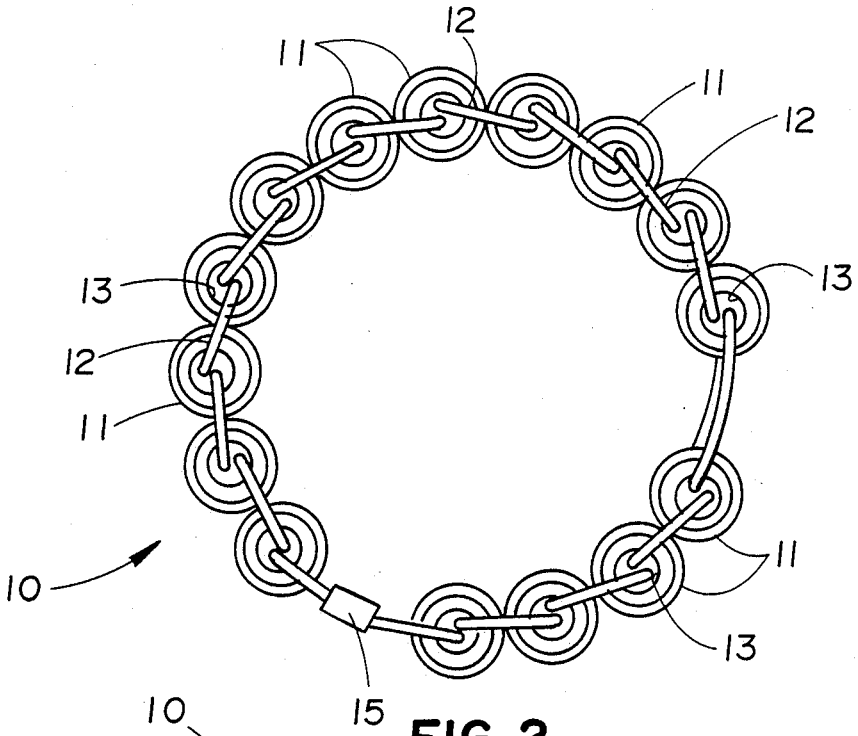
FIG. 2 is a top plan view of a second embodiment of the device of the present invention.

Referring now to the drawings, the device 10 for keeping score includes a plurality of counting beads 11 which are strung (or threaded) on a length of string 12, so that the beads 11 may be selectively moved (by sliding) as needed and/or desired for keeping the score of a player and which will stay (be maintained) in place and so moved until being subsequently moved (or reset).

The counting beads 11 may be round or any other shape as desired. However, as illustrated, is is preferred to utilize oblong, barrel-shaped beads. Each bead 11 has a passage 13 formed through at least a portion thereof. It is preferred that these passages 13 be formed extending radially through the center of each respective bead 11 (see, in particular, FIG. 3. In this respect, each of the beads 11 constitutes a shell. However, it should be noted that, if desired, passage 13 may be formed off centered or through an extension formed on each of the beads 11.

The length of string 12 is, preferrably, a length of elastic fabric string. Such a string 12 more readily allows for the movement of the beads 11 while maintaining such beads 11 in the particular position in which they have been placed (moved or slid).

Figure 8:
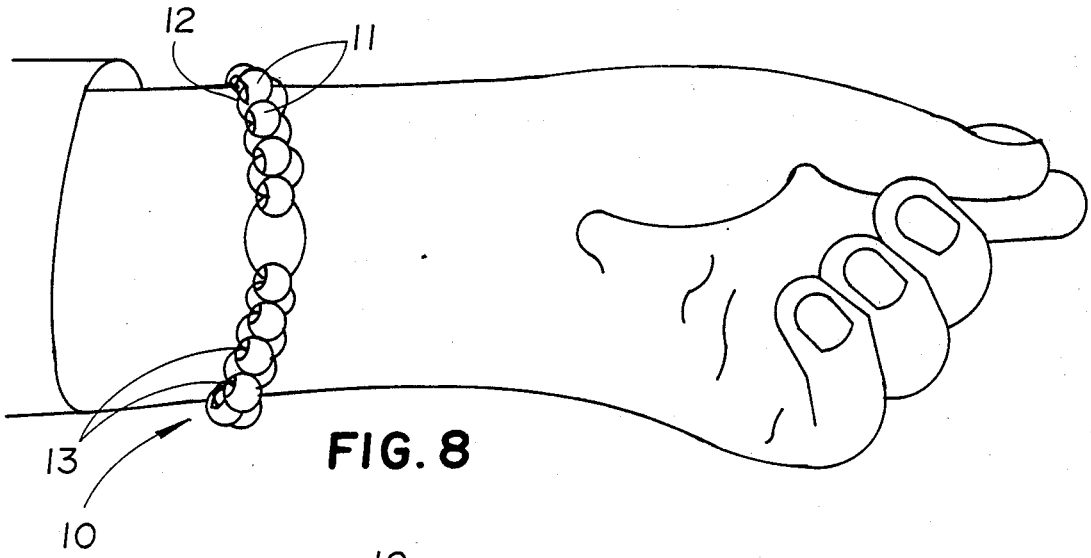
FIG. 8 illustrates the device of FIG. 2 worn on the wrist of a competitor.
Figure 9:
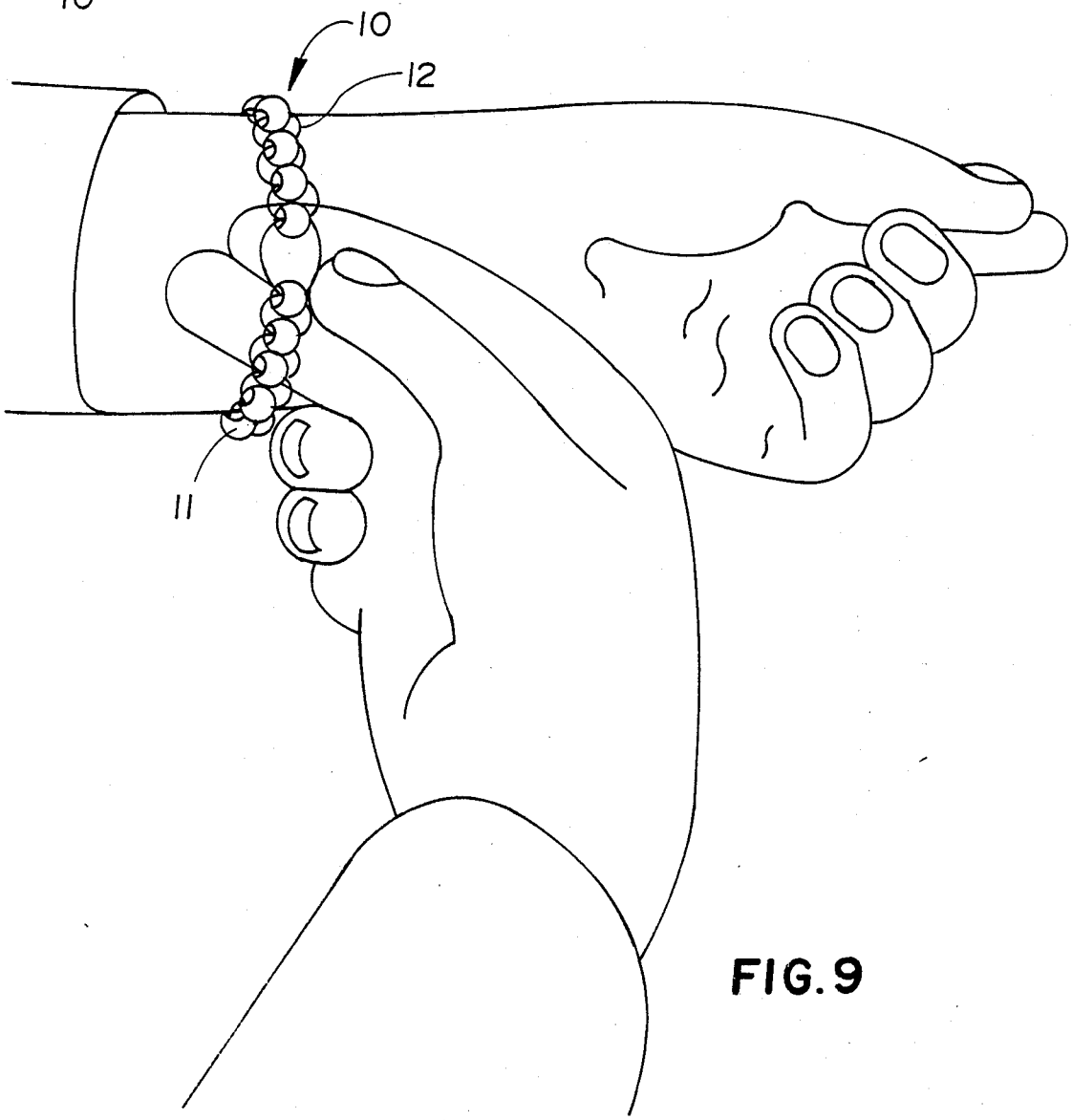
FIG. 9 illustrates a competitor keeping score by movement of a bead while the device of FIG. 2 is worn on the wrist.

String 12 has a pair of opposite ends 14 that have been joined to one another by any suitable means such as by the use of glue or by tying. Preferably, a perler bead 15 is utilized to effect such a liason. This joining maintains the beads 11 on the string 12. If desired, the opposite ends 14 may be removably joined together, such that the device may be selectively closed and opened for, respectively, retaining the beads 11 of the string 12 and for removing beads 11 from or placing additional beads on the string 12. It is also noted that the device 10 may be opened and closable for placement of the device of and removal from a support, such as a golf bag (See FIG. 6) or the wrist of a competitor (See FIGS. 7–9).

Figure 6:
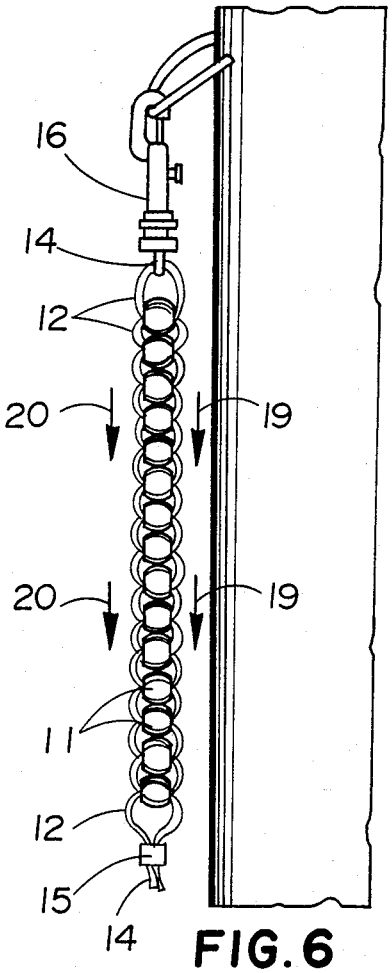
FIG. 6 illustrates the use of the device of FIG. 1.

With further reference to FIG. 6, it is noted that, if desired, a fastening means (such as snap hook 16) may be provided to secure the device 10 to the support.

Figure 3:
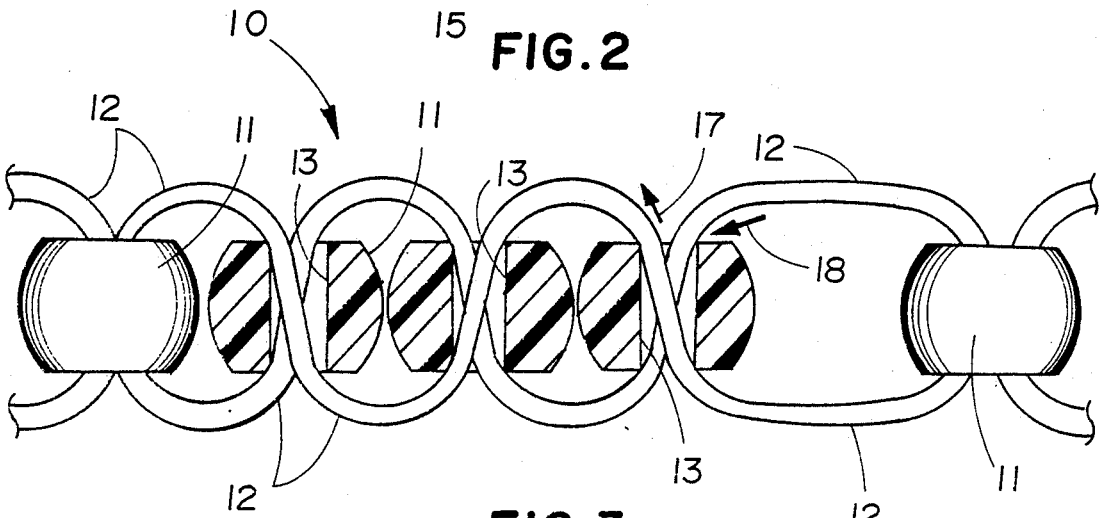
FIG. 3 is a side view of a portion of the device of the present invention with portions of some of the beads thereof broken away to reveal the threading of the length of string.

The string 12 has a first portion thereof that is strung (or threaded) in a serpentine manner through the passage 1 of each bead 11 in a first direction, as indicated by arrows 1 (FIG. 3). Similarly, the string 12 has a second portion that is strung (or threaded) in a serpentine manner through the passage 1 of each bead 11 in a second (opposite) direction, as indicated by arrows 18 (FIG. 3). As can be seen, threaded thusly each portion of the string 12 passes through the respective passages 13 in opposite directions to one another as indicated by the arrows 17 and 18, so as to overlap or cross over one another within the passage 13 of each bead 11. Such overlapping allows said beads 11 to be selective moved r slid along the length of string 12, as desired, while simultaneously providing a certain resistance preventing the beads 11 from freely moving on the string 12 and which aids in retaining and maintaining the beads in the position in which they were placed. It is further noted that the elasticity of the string 12 further aids in this regard.

Figure 7:
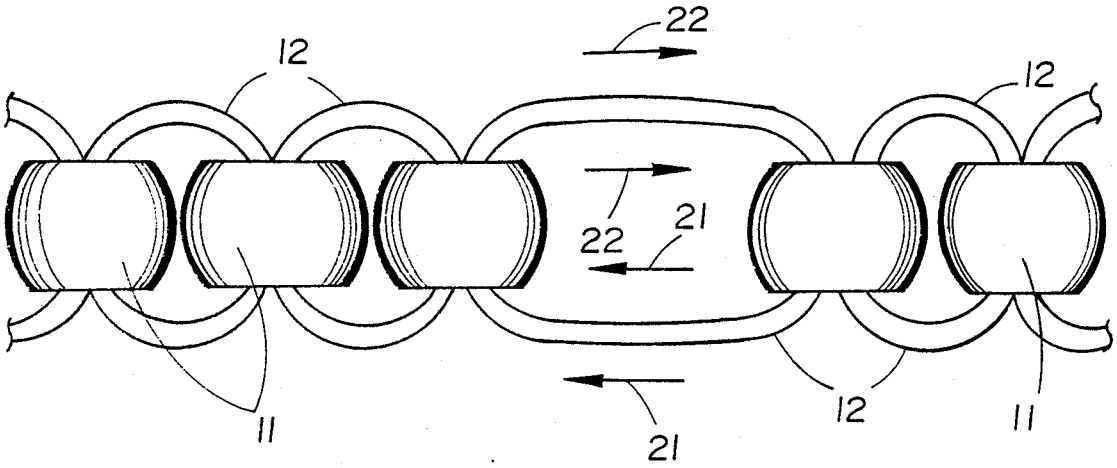
FIG. 7 illustrates the use of the device of FIG. 2.

It is also noted that the lengths of string 12 may, overall, be threaded either in generally the same direction (See, for example, arrows 19 and 20 of FIG. 6) or in opposite directions (See, for example, arrows 21 and 22 of FIG. 7). Finally, it is also noted that the passages 13 are each formed, so that the axis thereof extend substantially perpendicularly to these overall directions, as represented by arrows 19–22. Such an arrangement also aids in maintaining the beads 11 in the position in which they have been placed.

Figure 4:
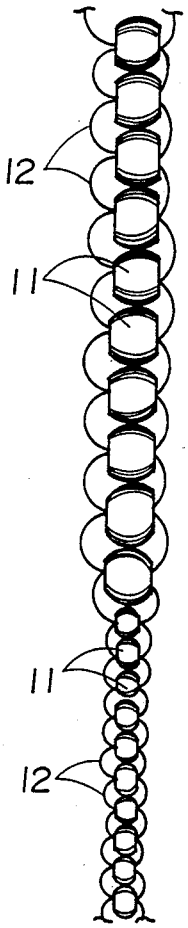
FIG. 4 is a perspective view of the device wherein the beads are formed so as to be readily tactally distinguishable from one another permitting groups of beads to be assigned different unit values.
Figure 5:
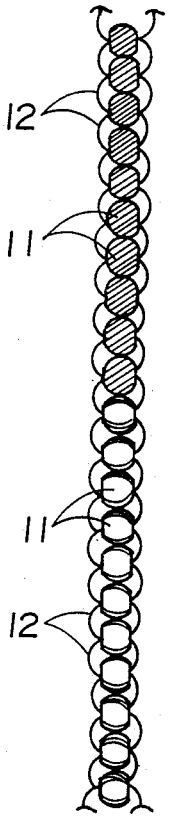
FIG. 5 is a perspective view of the device wherein the beads are formed so as to be readily visually distinguishable from one another permitting groups of beads to be assigned different unit values.

Finally, if desired, the beads 11 may be comprised of a first group and a second group that are readily distinguishable from one another either tactally or visually, so as to represent different units (i.e., ones, tens, hundreds, etc.) that the player can distinguish for use in counting and scoring. Tactal distinguishability may be provided by any suitable means, such as by providing external ribs on one of either the first or second groups. Preferably, such tactal distinguishability is provided by forming the two groups of beads so that one of the groups is larger than the other (FIG. 4). Visual distinguishability may also be provided by any suitable means, such as by making the first group of beads as a first color while the second group of beads is a second color (FIG. 5).

Obviously many modifications may be made without departing from the basic spirit of the present invention. Accordingly, it will be appreciated by those skilled in the art that with in the scope of the appended claims, the invention may be practiced other than has been specifically described herein.

What is claimed is:

1. A device for keeping score during a scoring game, said device comprised of:

a plurality of counting beads, each of said beads having a passage formed through at least a portion thereof; and a length of string having a pair of joined opposite ends, said string having a first portion thereof strung in a serpentine manner through the passage of each bead in a first direction and said length further having a second portion thereof strung in a serpentine manner through the passage of each bead in a second direction, such that the first and second portions of the length of string overlap one another within the passage of each bead forming a length of beaded string wherein the beads may be selectively slid along the length of the string and retained in position, permitting the score to be kept by the movement and placement of the beads.

2. The device of claim 1, wherein the respective passages are formed radially through a center of each respective bead.

3. The device of claim 1, wherein the string is an elastic fabric string.

4. The device of claim 1 wherein the beads are substantially round.

5. The device of claim 1, wherein the opposite ends of the length of string are removably joined together, such that the device may selectively be closed for retaining the beads on the string and opened for removing beads from or placing additional beads on the string and/or placement of the device on or removal from a support.

6. The device of claim 1, wherein the beads are oblong, barrel-shaped beads.

7. The device of claim 1, wherein the opposite ends of the length of string are joined to one another with a perler bead.

8. The device of claim 1, wherein the beads include at least a first group of beads and a second group of beads, such that the first and second group of beads are distinguishable from one another permitting a player to distinguish the groups of beads from one another for use in counting and scoring different units.

9. The device of claim 8, wherein the respective beads of the first group are tactally distinguishable from the respective beads of the second group.

10. The device of claim 9, wherein the respective beads of the first group are a different size than the respective beads of the second group.

11. The device of claim 8, wherein the respective beads of the first group are visually distinguishable from the respective beads of the second group.

12. The device of claim 11, wherein the respective beads of the first group are a first color and wherein the respective beads of the second group are a second color being different from the first color.

13. A device for keeping score during a scoring game, said device comprised of:

a plurality of counting beads, each of said beads having a passage formed through at least a portion thereof;

a length of elastic fabric string having a pair of opposite ends, said string having a first portion thereof threaded in a serpentine manner through the passage of each bead in a first direction and said length further having a second portion thereof threaded in a serpentine manner through the passage of each bead in a second, opposite direction, such that the first and second portions of the length of string overlap one another within the passage of each bead forming a length of beaded string wherein the beads may be selectively slid along the length of string and retained in the shifted position, permitting the score to be kept by the movement and placement of the beads; and wherein the opposite ends of the length of string are removably joined together, such that the device may be selectively opened and closed.

14. A device for keeping score during a scoring game, said device comprised of:

a plurality of counting beads, each of said beads having a passage formed through at least a portion thereof; and a length of elastic fabric string having pair of opposite ends joined to one another by a perler bead, said string having a first portion thereof threaded in a serpentine manner through the passage of each bead in a first direction and said length further having a second portion thereof threaded in a serpentine manner through the passage of each bead in a second opposite direction, such that the first and second portions of the length of string overlap one another within the passage of each bead forming a length of beaded string wherein the beads may be selectively slid along the length of string and retained in the shifted position, permitting the score to be kept by the movement and placement of the beads.

15. A device for keeping score during a scoring game, said device comprised of:

a plurality of counting beads, each of said beads having a passage formed through at least a portion thereof, said beads including at least a first group of beads and a second group of beads, such that the first and second group of beads are distinguishable from one another permitting a player to distinguish the groups of beads from one another for use in counting and scoring different units; and a length of elastic fabric string having a pair of joined opposite ends, said string having a first portion thereof threaded in a serpentine manner through the passage of each bead in a first direction and said length further having a second portion thereof threaded in a serpentine manner through the passage of each bead in a second opposite direction, such that the first and second portions of the length of string overlap one another within the passage of each bead forming a length of beaded string wherein the beads may be selectively slid along the length of string and retained in the shifted position, permitting the score to be kept by the movement and placement of the beads.

16. A device for keeping score during a scoring game, said device comprised of:

a plurality of oblong, barrel-shaped counting beads, each of said beads having a passage formed through at least a portion thereof, said beads including at least a first group of beads and a second group of beads, such that the first and second group of beads are distinguishable from one another permitting a player to distinguish the groups of beads from one another for use in counting and scoring different units; and a length of elastic fabric string having a pair of joined opposite ends, said string having a first portion thereof threaded in a serpentine manner through the passage of each bead in a first direction and said length further having a second portion thereof threaded in a serpentine manner through the passage of each bead in a second opposite direction, such that tee first and second portions of the length of string overlap one another within the passage of each bead forming a length of beaded string wherein the beads may be selectively slid along the length of string and retained in the shifted position, permitting the score to be kept by the movement and placement of the beads.

17. A device for keeping score during a scoring game, said device comprised of:

a plurality of counting beads, each of said beads having a passage formed through at least a portion thereof, said beads including at least a first group of beads and a second group of beads, such that the first and second group of beads are distinguishable from one another permitting a player to distinguish the groups of beads from one another for use in counting and scoring different units; and a length of elastic fabric string having a pair of opposite ends joined to one another by a perler bead, said string having a first portion thereof threaded in a serpentine manner through the passage of each bead in a first direction and said length further having a second portion thereof threaded in a serpentine manner through the passage of each bead in a second opposite direction, such that the first and second portions of the length of string overlap one another within the passage of each bead forming a length of beaded string wherein the beads may be selectively slid along the length of string and retained in the shifted position, permitting the score to be kept by the movement and placement of the beads.

18. A device for keeping score during a scoring game, said device comprised of:

a plurality of counting beads, each of said beads having a passage formed through at least a portion thereof, said beads including at least a first group of beads and a second group of beads such that the first and second group of beads are tactally distinguishable from one another permitting a player to distinguish the groups of beads from one another for use in counting and scoring different units; and a length of string having a pair of joined opposite ends, said string having a first portion thereof strung in a serpentine manner through the passage of each bead in a first direction and said length further having a second portion thereof strung in a serpentine manner through the passage of each bead in a second direction, such that the first and second portions of the length of string overlap one another within the passage of each bead forming a length of beaded string wherein the beads may be selectively slid along the length of a string and retained in position, permitting the score to be kept by the movement and placement of the beads.

19. A device for keeping score during a scoring game, said device comprised of:

a plurality of counting beads, each of said beads having a passage formed through at least a portion thereof, said beads including at least a first group of beads and a second group of beads, such that the first and second group of beads are visually distinguishable from one another permitting a player to distinguish the groups of beads from one another for use in counting and scoring different units; and a length of string having a pair of joined opposite ends, said string having a first portion thereof strung in a serpentine manner through the passage of each bead in a first direction and said length further having a second portion thereof strung in a serpentine manner through the passage of each bead in a second direction, such that the first and second portions of the length of string overlap one another within the passage of each bead forming a length of beaded string wherein the beads may be selectively slid along the length of the string and retained in position, permitting the score to be kept by the movement and placement of the beads.

20. A device for keeping score during a scoring game, said device comprised of:

a plurality of counting beads, each of said beads having a passage formed through at least a portion thereof, said beads including at least a first group of beads and a second group of beads such that the first and second group of beads are visually and tactally distinguishable from one another permitting a player to distinguish the groups of beads from one another for use in counting and scoring different units; and a length of string having a pair of joined opposite ends, said string having a first portion thereof strung in a serpentine manner through the passage of each bead in a first direction and said length further having a second portion thereof strung in a serpentine manner through the passage of each bead in a second direction, such that the first and second portions of the length of string overlap one another within the passage of each bead forming a length of beaded string wherein the beads may be selectively slid along the length of the string and retained in position, permitting the score to be kept by the movement and placement of the beads.

21. A device for keeping score during a scoring game, said device comprised of:

a plurality of counting beads, each of said beads having a passage formed through at least a portion thereof, said passages formed extending along respective axes; and a length of string having a pair of joined opposite ends, said string having a first portion thereof strung in a serpentine manner through the passage of each bead in a first direction, such that the first portion extends in a direction being substantially perpendicular to the axes of the beads and said length further having a second portion thereof strung in a serpentine manner through the passage of each bead in a second direction, such that the second portion extends in a direction being substantially perpendicular to the axes of the beads, and further such that the first and second portion of string overlap one another within the passage of each bead forming a length of beaded string, wherein the beads may be selectively slid along the length of the string and retained in position, permitting the score to be kept by the movement and placement of the beads.

* * * * *